US010480789B2

(12) United States Patent
Yokota et al.

(10) Patent No.: US 10,480,789 B2
(45) Date of Patent: Nov. 19, 2019

(54) HEAT-TRANSFER DEVICE AND GAS TURBINE COMBUSTOR WITH SAME

(71) Applicant: Mitsubishi Hitachi Power Systems, Ltd., Nishi-ku, Yokohama (JP)

(72) Inventors: Osami Yokota, Yokohama (JP); Shohei Numata, Yokohama (JP); Tomomi Koganezawa, Yokohama (JP); Tetsuma Tatsumi, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 59 days.

(21) Appl. No.: 14/742,962

(22) Filed: Jun. 18, 2015

(65) Prior Publication Data

US 2015/0369486 A1 Dec. 24, 2015

(30) Foreign Application Priority Data

Jun. 19, 2014 (JP) ..... 2014-126503

(51) Int. Cl.
*F23R 3/00* (2006.01)
*F23R 3/54* (2006.01)
*F15D 1/00* (2006.01)

(52) U.S. Cl.
CPC ..... *F23R 3/005* (2013.01); *F15D 1/009* (2013.01); *F23R 3/002* (2013.01); *F23R 3/54* (2013.01);

(Continued)

(58) Field of Classification Search
CPC .. F23R 3/005; F23R 3/002; F23R 3/54; F23R 2900/03045; F15D 1/009; F28F 13/02; F28F 13/12
See application file for complete search history.

(56) References Cited

U.S. PATENT DOCUMENTS 5,058,837 A * 10/1991 Wheeler ..... B64C 23/06 244/198
5,361,828 A * 11/1994 Lee ..... F01D 5/187 165/109.1

(Continued)

FOREIGN PATENT DOCUMENTS

CN 1829879 A 9/2006
CN 101307915 A 11/2008

(Continued)

OTHER PUBLICATIONS

Chinese-language Office Action issued in counterpart Chinese Application No. 201510338266.1 dated Mar. 16, 2017 (15 pages).

(Continued)

*Primary Examiner* — Steven M Sutherland
(74) *Attorney, Agent, or Firm* — Crowell & Moring LLP

(57) ABSTRACT

Disclosed is a heat-transfer device adapted to enhance uniformity of cooling characteristics to be given to a heat transfer object, and thereby to extend a life of the heat transfer object. The heat-transfer device for facilitating heat exchange between combustion air (heat transfer medium) flowing along an outer surface of a combustor liner (heat transfer object), and the combustor liner, the heat-transfer device including at least one longitudinal vortex generating device protruding toward a annular passage (flow passage) of the combustion air and formed to generate a longitudinal vortex E with a central axis in a flow direction of the combustion air, and stir the combustion air flowing in the annular passage; and at least one radiator fin provided in a region A on the outer surface of the combustor liner, the region A being where a flow of the vortex E, on a swirling plane thereof, that are generated by the vortex generating device is directed from a side of the combustor liner, toward (Continued)

a side of a flow sleeve, the fin exchanging heat with the combustion air stirred by the vortex generating device.

11 Claims, 11 Drawing Sheets

(52) U.S. Cl.
CPC ..... *F23R 2900/03044* (2013.01); *F23R 2900/03045* (2013.01)

(56) References Cited

U.S. PATENT DOCUMENTS

| | | | | |
|---|---|---|---|---|
| 7,849,694 | B2 | 12/2010 | Dahlke et al. | |
| 8,596,073 | B2 | 12/2013 | Zhang | |
| 8,904,802 | B2 | 12/2014 | Kodukulla et al. | |
| 2009/0077974 | A1 | 3/2009 | Dahlke et al. | |
| 2010/0011738 | A1 | 1/2010 | Zhang | |
| 2010/0302730 | A1* | 12/2010 | Hernon | H05K 7/20145 361/694 |
| 2012/0012284 | A1* | 1/2012 | Salamon | F28F 3/048 165/109.1 |
| 2013/0000312 | A1 | 1/2013 | Kodukulla et al. | |
| 2014/0020393 | A1 | 1/2014 | Nakamata et al. | |

FOREIGN PATENT DOCUMENTS

| | | | |
|---|---|---|---|
| CN | 101629516 | A | 1/2010 |
| CN | 102853450 | A | 1/2013 |
| CN | 103534531 | A | 1/2014 |
| EP | 2 541 146 | A2 | 1/2013 |
| EP | 2 770 258 | A2 | 8/2014 |
| EP | 2 860 452 | A1 | 4/2015 |
| JP | 10-82527 | A | 3/1998 |
| JP | 2000-320837 | A | 11/2000 |
| JP | 2001-280154 | A | 10/2001 |
| JP | 2014-98352 | A | 5/2014 |
| JP | 2014-98508 | A | 5/2014 |
| WO | WO 2013/154626 | A1 | 10/2013 |

OTHER PUBLICATIONS

Extended European Search Report issued in counterpart European Application No. 15172794.8 dated Oct. 15, 2015 (six (6) pages).

Japanese-language Office Action issued in counterpart Japanese Application No. 2014-126503 dated Sep. 26, 2017 (Three (3) pages).

* cited by examiner

HEAT-TRANSFER DEVICE AND GAS TURBINE COMBUSTOR WITH SAME

BACKGROUND OF THE INVENTION

1. Field of the Invention

The present invention relates to heat-transfer devices and to gas turbine combustors having the same.

2. Description of Related Art

Combustor liners, turbine blades, heat exchange equipment, fins, steam boilers, and other gas turbine components are adapted to promote heat transfer between a fluid and a solid in processes such as cooling and heat exchange therein. Varieties of structures for such a heat transfer promotion are discussed in accordance with the specifications required of these components.

For example, combustors for power-generating gas turbines are required to maintain necessary cooling performance with low pressure loss causing no deterioration in gas turbine efficiency, and thereby to maintain reliability of structural strength. In addition, reduction in emission levels of the nitrogen oxide (NOx) gases generated in the combustors is required in terms of paying due attention to environmental issues. The reduction in NOx gas emissions can be achieved by using premixed combustion, in which a fuel and air are mixed well prior to burning, and by burning this mixture at a fuel-air ratio smaller than a stoichiometric ratio of the fuel to air.

A heat-transfer device (heat transfer structure) of a gas turbine combustor, designed with the above in mind, is proposed in JP-2001-280154-A. In the heat-transfer device (heat transfer structure) of JP-2001-280154-A, longitudinal vortex generating devices that generate spiral vortices (longitudinal vortices) having a central axis of their swirling in a flow direction of high-pressure air from a compressor are disposed on an outer circumferential surface of a cylindrical combustor liner along which the high-pressure air flows. The longitudinal vortex generating devices are arranged side by side both axially and circumferentially on the combustor liner, and the longitudinal vortex generating devices arranged adjacently to each other circumferentially on the combustor liner are formed to swirl the respective vortices in directions opposite to each other. In addition, turbulent-flow enhancers that destroy a boundary layer generated in the high-pressure air are disposed between the longitudinal vortex generating devices arranged side by side axially on the combustor liner.

SUMMARY OF THE INVENTION

In the heat-transfer device of JP-2001-280154-A, the longitudinal vortex generating devices arranged adjacently to each other circumferentially on the combustor liner are formed to swirl the respective vortices in the opposite directions with respect to each other, thereby preventing the adjacently swirling vortices from canceling out each other. Accordingly, two regions different in flow direction of the longitudinal vortices, on a swirling plane thereof, that have been generated by the longitudinal vortex generating devices exist in a flow passage of the high-pressure air. That is to say, one of the two regions is a region in which the flow direction of the longitudinal vortices, on the swirling plane thereof, points from an inner circumferential side of the flow passage (i.e., the combustor liner side), toward an outer circumferential side of the flow passage (i.e., a flow sleeve side), and the other is a region in which the flow direction of the longitudinal vortices, on the swirling plane thereof, points from the outer circumferential side of the flow passage (i.e., the flow sleeve side), toward the inner circumferential side of the flow passage (i.e., the combustor liner side).

At one section of the combustor liner that is positioned in the region where the longitudinal vortex swirls from the flow sleeve side toward the combustor liner side, impact effect of the longitudinal vortex upon the combustor liner is added to impart better heat transfer characteristics (cooling characteristics) to the combustor liner. Conversely at the other section of the combustor liner that is positioned in the region where the longitudinal vortex swirls from the combustor liner side toward the flow sleeve side, the impact effect of the longitudinal vortex cannot be obtained, so that the heat transfer characteristics (cooling characteristics) at the other section of the combustor liner tends to decrease relative to those at the one section of the combustor liner. As a result, a temperature distribution in the circumferential direction of the combustor liner, a heat transfer object to which heat is transferred, is estimated to become nonuniform, thus cause thermal stresses, and hence accelerate cracking, which may in turn shorten a life of the combustor liner.

The present invention has been made for solving the above problems, and an object of the invention is to provide a heat-transfer device adapted to enhance uniformity of cooling characteristics to be given to a heat transfer object, and thereby to extend a life of the heat transfer object.

The present invention includes a plurality of devices for solving the above problems. Among these devices is, for example, a heat-transfer device for facilitating heat exchange between a heat transfer object and a heat transfer medium flowing along a surface of the heat transfer object, the heat-transfer device including: at least one longitudinal vortex generating device protruding toward a flow passage of the heat transfer medium, the at least one longitudinal vortex generating device being configured to generate a longitudinal vortex with a central axis in a flow direction of the heat transfer medium to stir the heat transfer medium flowing in the flow passage; and at least one radiator fin provided in a region on the surface of the heat transfer object, the region being where a flow of the longitudinal vortex, on a swirling plane of the vortex, that is generated by the at least one longitudinal vortex generating device is directed away from a heat transfer object side, the at least one radiator fin being configured to exchange heat with the heat transfer medium stirred by the at least one longitudinal vortex generating device.

In the present invention, the at least one radiator fin is disposed at a section of the heat transfer object, the section being positioned in the region where impact effect of the longitudinal vortex generated by the at least one longitudinal vortex generating device cannot be obtained. Cooling characteristics for the heat transfer target thus become satisfied at the region where the impact effect of the longitudinal vortex cannot be obtained, as well as at the region where the impact effect of the longitudinal vortex can be obtained. Therefore, uniformity of the cooling characteristics for the heat transfer object can be enhanced. This reduces thermal stresses due to sharp changes in temperature, thus extending a life of the heat transfer object.

The other problems, configurations, and advantageous effects will be made apparent by the following description of embodiments.

DESCRIPTION OF THE PREFERRED EMBODIMENTS

Hereunder, embodiments of a heat-transfer device according to the present invention will now be described with reference to the accompanying drawings. While the heat-transfer device according to the present invention covers a wide range of applications, a gas turbine combustor internally becoming a high-temperature region during operation and generating a turbulent flow field of fluids will be described here by way of example.

First Embodiment

A heat-transfer device and a gas turbine combustor including the heat-transfer device according to a first embodiment of the present invention are described below with reference to FIGS. 1 to 5.

Figure 1:
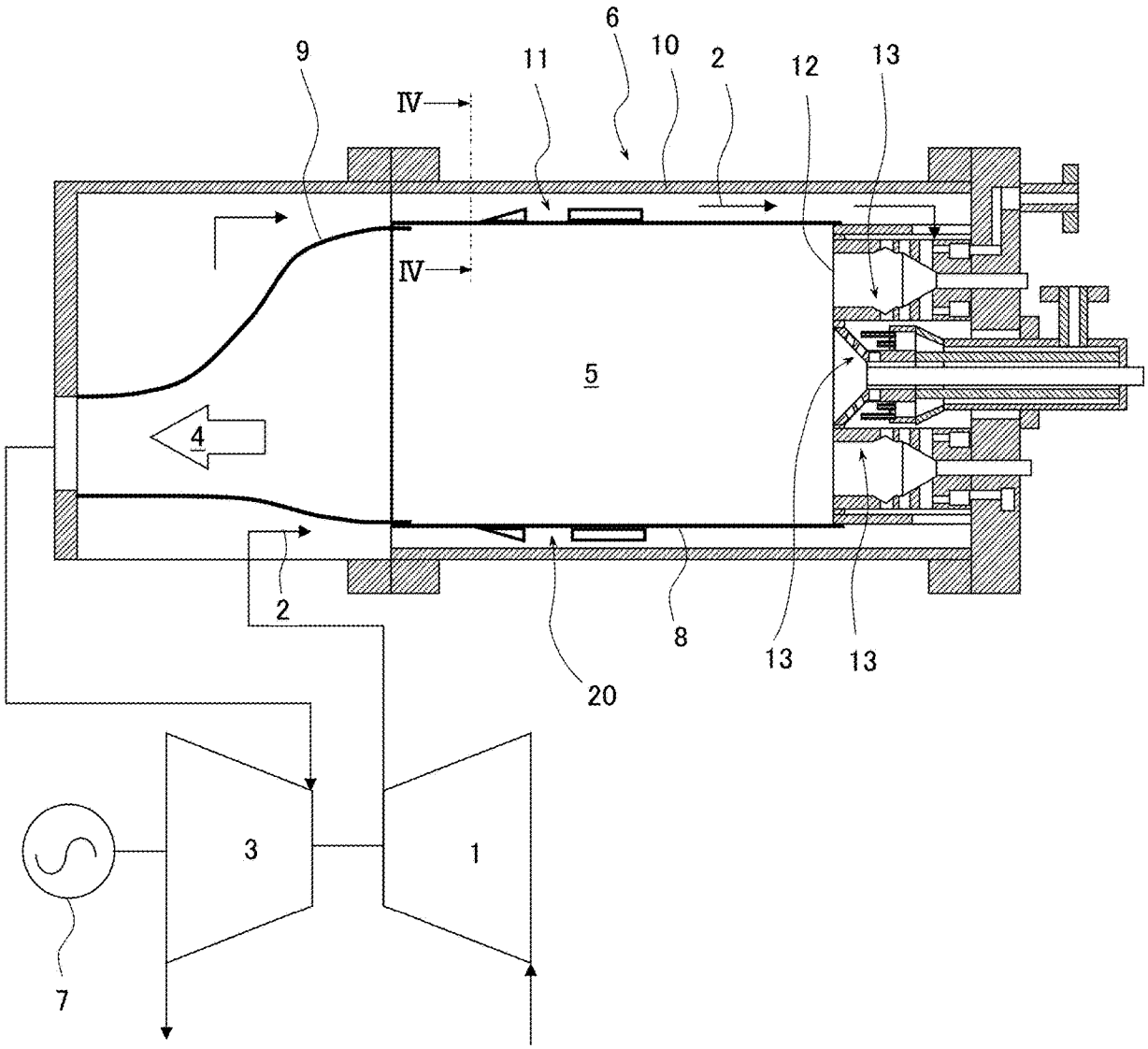
FIG. 1 is a longitudinal sectional view showing a gas turbine combustor having a heat-transfer device according to a first embodiment of the present invention, FIG. 1 also being a schematic configuration diagram of a gas turbine plant having the gas turbine combustor.

The first embodiment of the gas turbine combustor including the heat-transfer device is first described with reference to FIG. 1. FIG. 1 is a longitudinal sectional view showing the gas turbine combustor having the heat-transfer device according to the first embodiment of the invention, FIG. 1 also being a schematic configuration diagram of the gas turbine plant having the gas turbine combustor. The largest arrow in FIG. 1 indicates a direction in which a working fluid in the gas turbine plant flows.

The gas turbine plant in FIG. 1 includes: a compressor 1 that compresses air to generate high-pressure combustion air 2 (compressed air); a combustor 6 that generates high-temperature combustion gas 4 by mixing fuel with the combustion air 2 introduced from the compressor 1, and burning the resulting mixture; a turbine 3 that obtains shaft driving force from energy of the combustion gas 4 generated by the combustor 6; and a generator 7 that is driven by the turbine 3 to generate electricity.

The compressor 1, the turbine 3, and the generator 7 have respective rotating shafts mechanically coupled together.

The combustor 6 includes: a flow sleeve (outer casing) 10; a cylindrical combustor liner (inner casing) 8 disposed inside the flow sleeve 10 with a clearance intervening therebetween, the combustor liner 8 forming a combustion chamber 5 inside thereof; a transition piece (tail pipe) 9 contiguously connected to an opening of a turbine side of the combustor liner 8 so as to guide to the turbine 3 the combustion gas 4 generated in the combustion chamber 5; a substantially disc-shaped plate 12 totally blocking an opening of an upstream end of the combustor liner 8 in the flow direction of the combustion gas 4, the plate 12 being disposed substantially perpendicular to a central axis of the combustor liner 8 so that one side face of the plate 12 faces the combustion chamber 5; and a plurality of burners 13 each disposed on the plate 12.

An annular flow passage 11 through which the combustion air 2 from the compressor 1 will flow is formed between the flow sleeve 10 and the combustor liner 8.

On one hand, the combustor liner 8 is heated by heat transfer of the combustion gas 4 generated in the combustion chamber 5 present inside the combustor liner 8. On the other hand, the combustor liner 8 is cooled by heat exchange with the combustion air 2 flowing along an outer circumferential surface of the combustor liner 8. On the outer circumference of the combustion liner 8, a heat-transfer device 20 is placed as an element for facilitating heat exchange between the combustor liner 8 as a heat transfer object and the combustion air 2 as a heat transfer medium flowing along a surface of the heat transfer object.

Next, a further detailed configuration of the heat-transfer device according to the first embodiment of the present invention is described below with reference to FIGS. 2 to 5.

Figure 2:
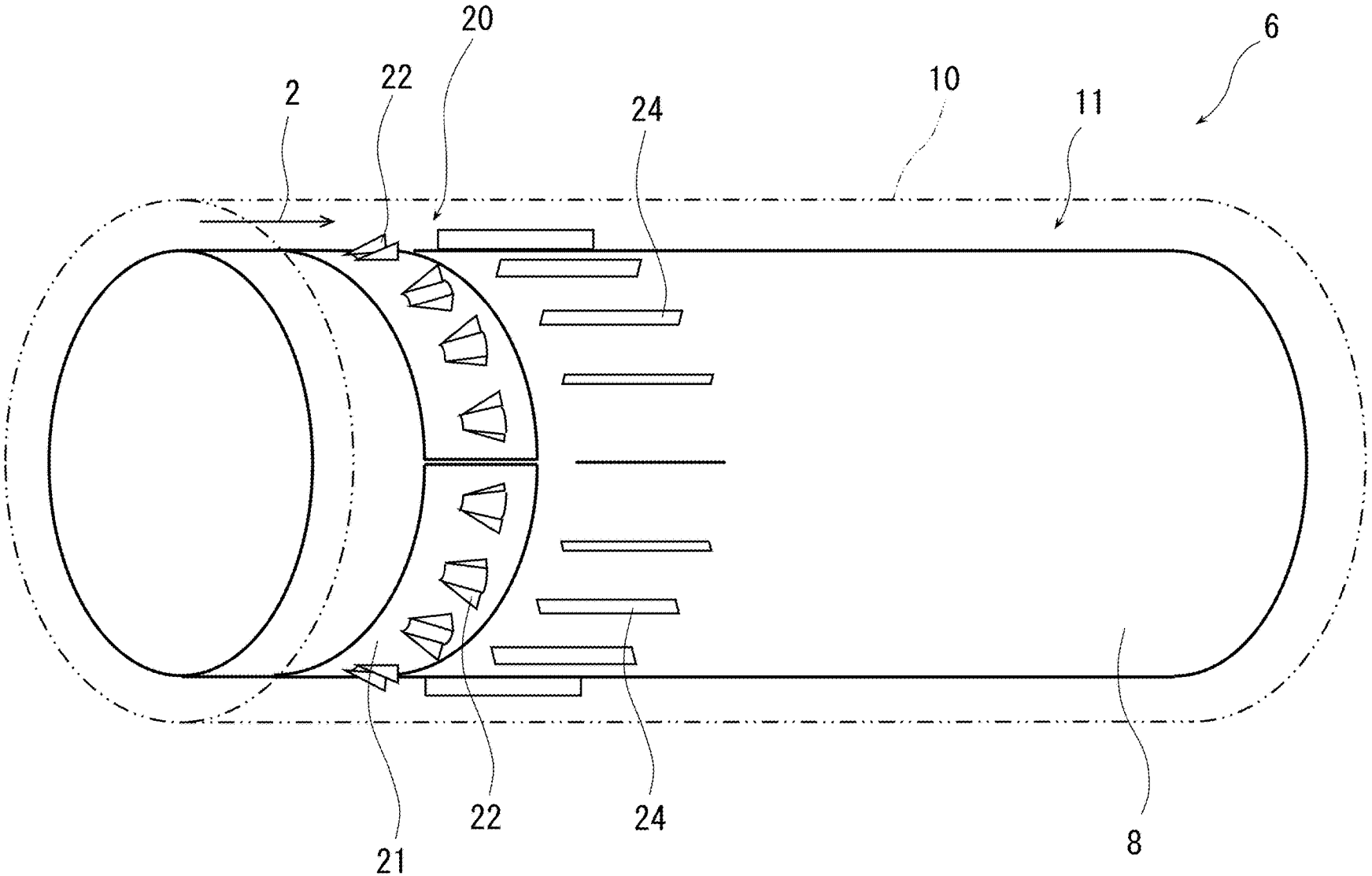
FIG. 2 is a schematic perspective view showing the heat-transfer device according to the first embodiment of the present invention, shown in FIG. 1, and a combustor liner that forms a part of the gas turbine combustor having the heat-transfer device.
Figure 3:
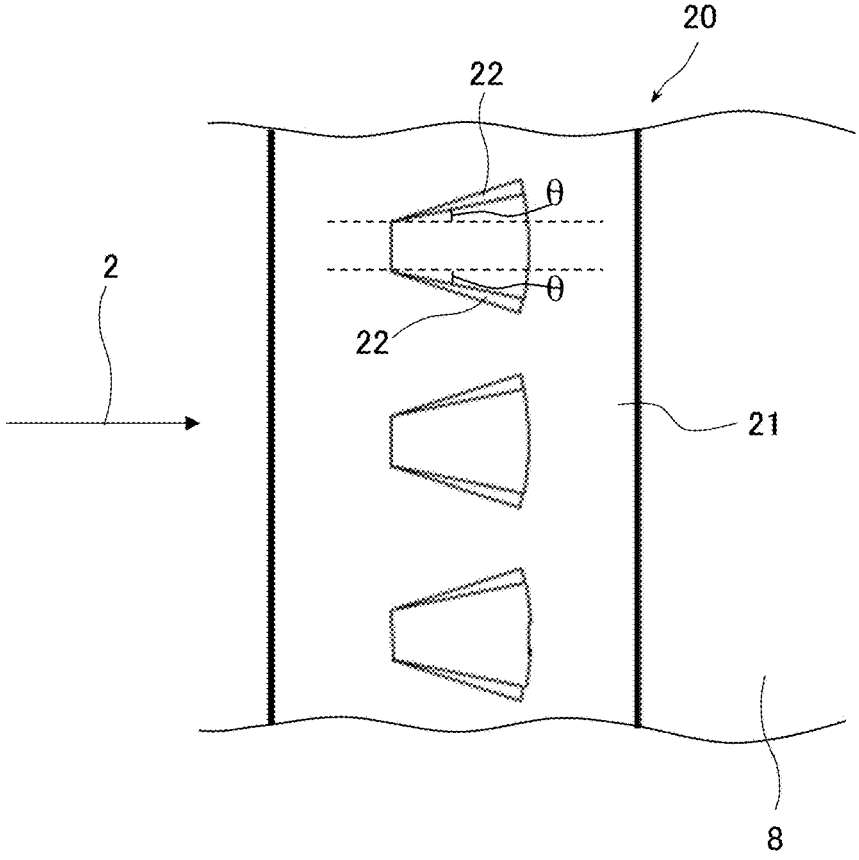
FIG. 3 is a plan view that shows construction of longitudinal vortex generating devices which form parts of the heat-transfer device according to the first embodiment of the present invention, shown in FIG. 2.
Figure 4:
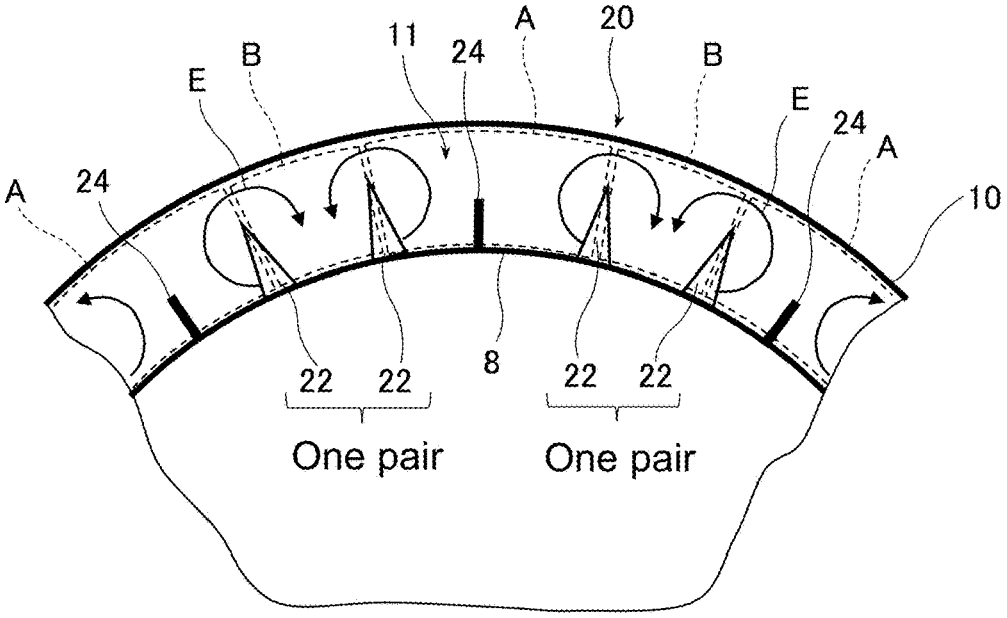
FIG. 4 is a schematic cross-sectional view taken from a direction of an arrow, along section IV-IV of a portion of the gas turbine combustor having the heat-transfer device according to the first embodiment of the present invention, shown in FIG. 1, the cross-sectional view being shown to illustrate flow directions on swirling planes of longitudinal vortices generated by the longitudinal vortex generating devices.
Figure 5:
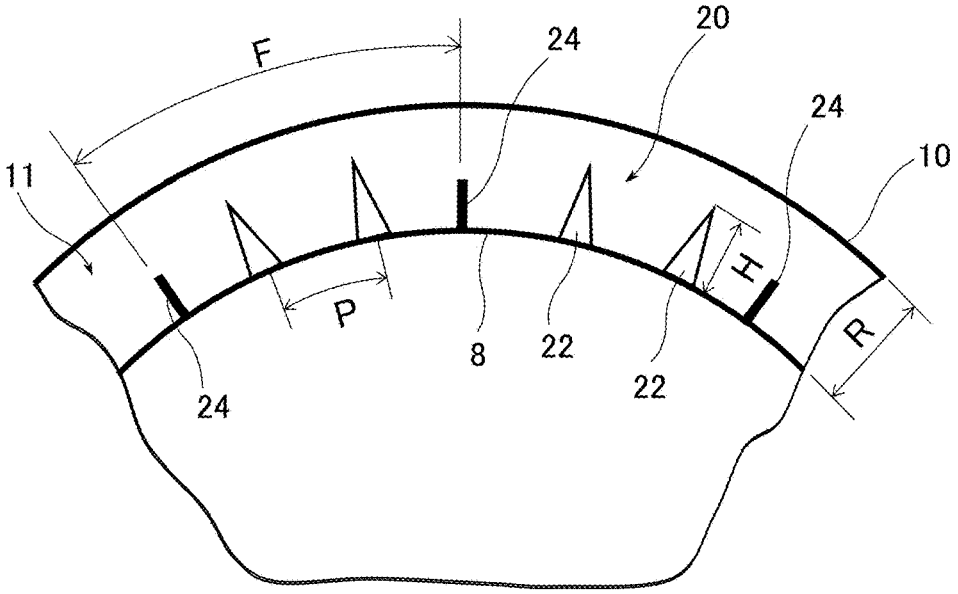
FIG. 5 is an explanatory diagram that shows geometry, layout, and other factors of radiator fins and the longitudinal vortex generating devices, both of which form parts of the heat-transfer device according to the first embodiment of the present invention, shown in FIG. 4.

FIG. 2 is a schematic perspective view showing the heat-transfer device according to the first embodiment of the present invention, shown in FIG. 1, and the combustor liner that forms a part of the gas turbine combustor having the heat-transfer device. FIG. 3 is a plan view that shows construction of longitudinal vortex generating devices which form parts of the heat-transfer device according to the first embodiment of the present invention, shown in FIG. 2. FIG. 4 is a schematic cross-sectional view taken from a direction of an arrow, along section IV-IV of a portion of the gas turbine combustor having the heat-transfer device according to the first embodiment of the present invention, shown in FIG. 1. FIG. 5 is an explanatory diagram that shows geometry, layout, and other factors of radiator fins and the longitudinal vortex generating devices, both of which form parts of the heat-transfer device according to the first embodiment of the present invention, shown in FIG. 4. Arrows shown in FIGS. 2 and 3 indicate flow directions of the combustion air 2. Arrows shown in FIG. 4 indicate swirling directions of longitudinal vortices E. Referring to FIG. 1, the same elements as used in FIGS. 2 to 5 are each assigned the same reference number and detailed description of these elements is therefore omitted herein.

Referring to FIG. 2, the combustor liner 8 of the combustor 6 is formed by a cylindrical member. The heat-transfer device 20 is disposed on the outer circumferential surface of the combustion liner 8, at an upstream portion in the flow direction of the combustion air 2.

The heat-transfer device 20 has a feature that it includes the longitudinal vortex generating devices 22 and radiator fins 24 arranged on the outer circumferential surface of the combustion liner 8 which requires cooling. In terms of a more specific configuration, the heat-transfer device 20 includes, for example, a belt-shaped strap member 21 encircling the combustor liner 8 from the outer circumference of the liner, the longitudinal vortex generating devices 22 each formed on the belt-shaped strap member 21, and the radiator fins 24 each disposed in a standing condition on the outer circumferential surface of the combustion liner 8. Each of the radiator fins 24 is disposed downstream of the longitudinal vortex generating devices 22 in the flow direction of the combustion air 2.

The strap member 21 shown by way of example in FIG. 2 is formed in a substantially rectangular shape and wound around the outer circumferential surface of the combustion liner 8. An example of a way to fix the strap member 21 to the outer circumferential surface of the combustion liner 8 is by having a rectangular plate material available for use as the strap member 21, and after winding it around the outer circumferential surface of the combustion liner 8, connecting a plurality of sections of the strap member 21 on the combustion liner 8 by means of spot welding. The strap member 21, initially a rectangular plate material, is bent into a cylindrical shape to form a belt-shaped member such as that shown in the figure. Before the strap member 21 is wound around the combustor liner 8, the longitudinal vortex generating devices 22 are preferably molded to fit on the strap member 21, as will be later described. Winding the strap member 21 around the combustor liner 8 integrates them and increases local plate thickness of the combustor liner 8. This method also increases structural strength of the combustor liner 8, thus improving reliability of the liner 8.

Each of The longitudinal vortex generating devices 22 is, for example, a convex blade protruding from the strap member 21 toward the annular passage 11, and has an edge gradually rising as it goes downstream of the combustion air 2. The longitudinal vortex generating devices 22 are molded to form a pair of blades spread from side to side (in a circumferential direction of the strap member 21) toward a downstream side at a predetermined angle θ (say, from 10 to 20 degrees) with respect to the flow direction of the combustion air 2. As shown in FIGS. 2 and 3, a plurality of pairs of blades are arranged at predetermined intervals circumferentially on the strap member 21, that is, in a direction perpendicular to the flow direction of the combustion air 2. That is to say, adjacent longitudinal vortex generating devices 22 are provided so that respective inclinations of the blades in the circumferential direction of the strap member 21 (that is, in a direction parallel to the outer surface of the combustor liner 8) relative to the flow direction of the combustion air 2 are in opposite directions with respect to one another. A method of providing the longitudinal vortex generating devices 22 on the strap member 21 is by pressing with a press machine a die appropriate for the shape of the longitudinal vortex generating devices 22. One pair of longitudinal vortex generating devices 22 (paired blades spread from side to side at the angle θ) are molded by one press operation.

When the longitudinal vortex generating devices 22 are constructed in the above manner, longitudinal vortices E with central axes in the flow direction of the combustion air 2 are generated as shown in FIG. 4. The paired longitudinal vortex generating devices 22, the paired blades spread sideways, generate the longitudinal vortices E that swirl in the opposite directions with respect to one another.

Each of the longitudinal vortices E has two regions different in flow direction on a swirling plane. One is a region A in which the flow direction of the longitudinal vortex E on the swirling plane is heading from an inner circumferential side of the annular passage 11 (i.e., the side closer to the combustor liner 8), toward an outer circumferential side of the annular passage 11 (i.e., the side closer to the flow sleeve 10). The other is a region B in which the flow direction is heading from the outer circumferential side of the annular passage 11 (i.e., the side closer to the flow sleeve 10), toward the inner circumferential side of the annular passage 11 (i.e., the side closer to the combustor liner 8). At a section of the combustor liner 8 that is positioned in the region B where the flow direction of the longitudinal vortex E on the swirling plane is heading from the side closer to the flow sleeve 10, toward the side closer to the combustor liner 8, impact effect of the longitudinal vortex E can be obtained, which imparts better heat transfer characteristics (cooling characteristics) to the liner surface. Conversely at a section of the combustor liner 8 that is positioned in the region A where the flow direction of the longitudinal vortex E on the swirling plane is heading from the side closer to the combustor liner 8, toward the side closer to the flow sleeve 10, the impact effect of the longitudinal vortex E cannot be obtained, so that the heat transfer characteristics (cooling characteristics) of the liner surface tend to decrease relative to those obtained at the section of the combustor liner 8 that is positioned in the region A.

The present embodiment, therefore, includes radiator fins 24 at the sections of the combustor liner 8 where the impact effect of the longitudinal vortices E cannot be obtained. In other words, the radiator fins 24 are disposed at the sections of the outer circumferential surface of the combustor liner 8 that are positioned in the regions A where the flow directions of the longitudinal vortices E on the swirling planes are heading from the side closer to the combustor liner 8 toward the side closer to the flow sleeve (i.e., in the direction that the flows of the vortices move away from the combustor liner 8).

More specifically, each of the radiator fins 24 is, for example, structurally a substantially rectangular plate-shaped member extending in the flow direction of the combustion air 2, as shown in FIG. 2. In addition, the radiator fins 24 are disposed at predetermined intervals circumferentially on the combustor liner 8. As shown in FIG. 4, when the combustor liner 8 is viewed from the flow direction of the combustion air 2, the radiator fins 24 are positioned between one pair of circumferentially adjacent longitudinal vortex generating devices 22 and another pair of circumferentially adjacent longitudinal vortex generating devices 22, where the pair of the longitudinal vortex generating devices 22 are the devices 22 spread from side to side (see FIG. 3). Integration by centrifugal casting, welding, brazing, or the like, can be used as a method of disposing the radiator fins 24 on the outer circumferential surface of the combustor liner 8.

In the heat-transfer device 20 having the above configuration, if as shown in FIG. 5, height of the longitudinal vortex generating devices 22, a pitch of the longitudinal vortex generating devices 22, the interval of the radiator fins 24, and a gap of the annular passage 11 in a direction perpendicular to the combustor liner 8 are respectively defined as H, P, F, and R, these parameters desirably fall within predetermined relationships. That is to say:

- the desirable relationship between the gap R of the annular passage 11 and the pitch P of the longitudinal vortex generating devices 22 is $0.5 \leq R/P \leq 3.8$;
- the desirable relationship between the gap R of the annular passage 11 and the height H of the longitudinal vortex generating devices 22 is $1.1 \leq R/H \leq 5.0$; and
- the desirable relationship between the interval F of the radiator fins 24 and the gap R of the annular passage 11 is $0.5 \leq F/R \leq 3.6$.

Next, the reasons why the above relational expressions have been set are described below with reference to FIGS. 6 to 8.

The heat transfer characteristics of the heat-transfer device 20 having the above configuration significantly change according to heat balance as well as a particular combination of various parameters such as the height and angle θ of the longitudinal vortex generating devices 22 and the pitch, thickness, height, and shape of the radiator fins 24. Accordingly, a quantitative description of the heat transfer characteristics is avoided here and only a qualitative description is given below.

Figure 6:
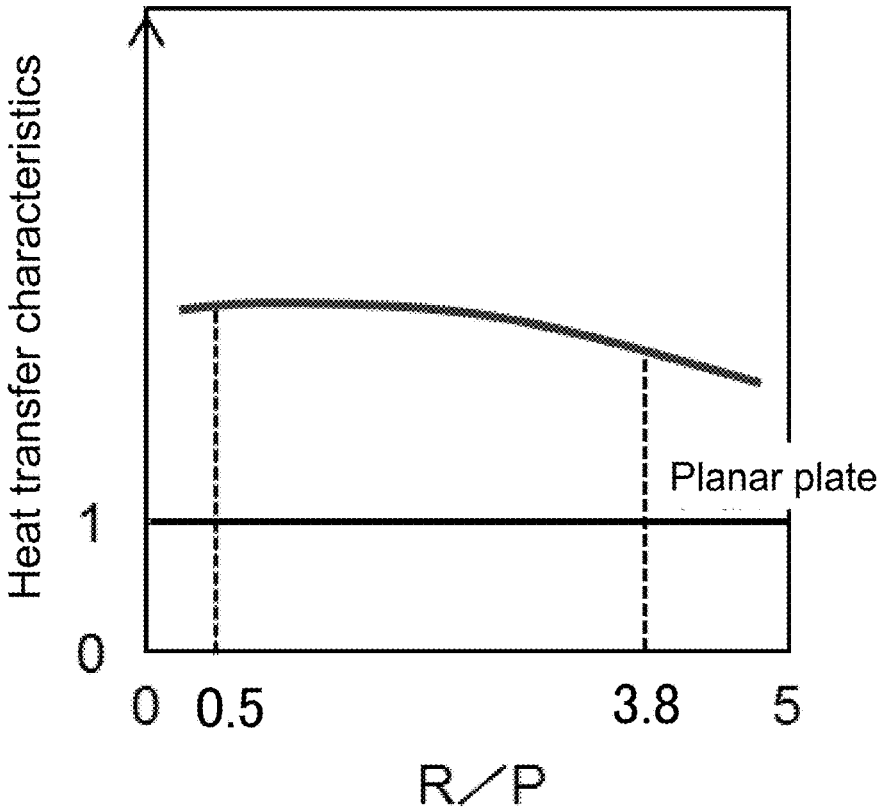
FIG. 6 is a characteristics diagram that represents a relationship between heat transfer characteristics and a ratio of a gap of an annular passage to a pitch of the longitudinal vortex generating devices, represented in FIG. 5.
Figure 7:
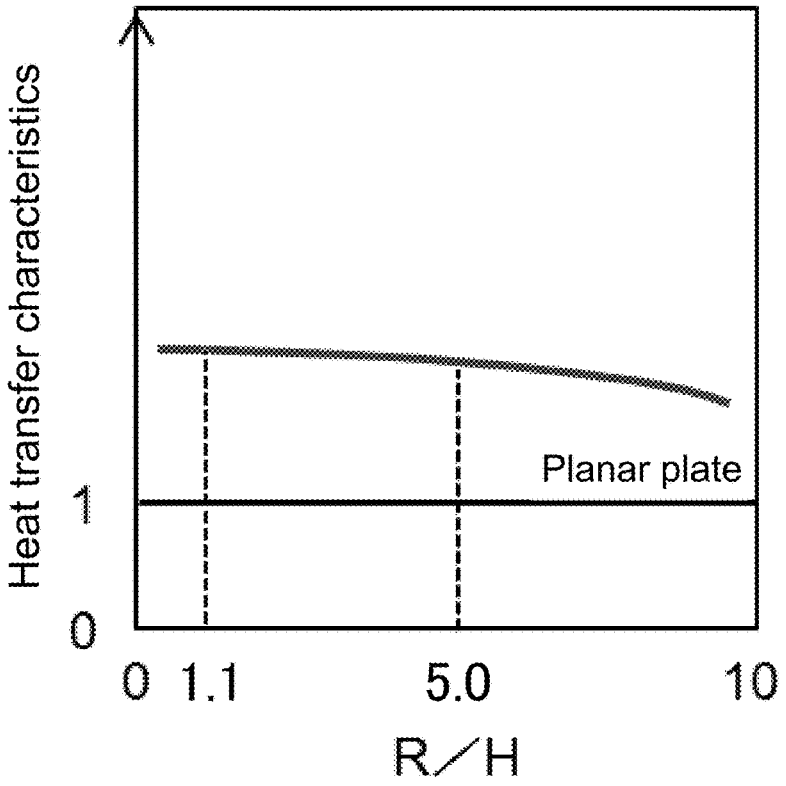
FIG. 7 is a characteristics diagram that represents a relationship between heat transfer characteristics and a ratio of the gap of the annular passage to height of the longitudinal vortex generating devices, represented in FIG. 5.
Figure 8:
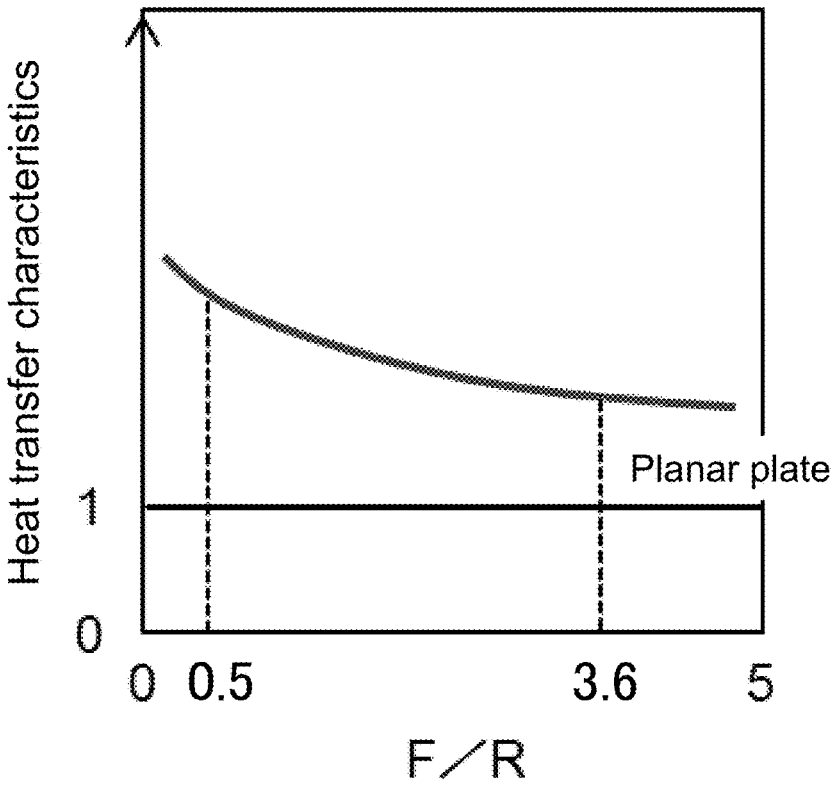
FIG. 8 is a characteristics diagram that represents a relationship between heat transfer characteristics and a ratio of an interval of the radiator fins to the gap of the annular passage, represented in FIG. 5.

FIGS. 6 to 8 represent a qualitative concept of the heat transfer characteristics of the heat-transfer device with a specific structure as a typical example. FIG. 6 is a characteristics diagram representing a relationship between the heat transfer characteristics and the ratio of the gap of the annular passage to the pitch of the longitudinal vortex generating devices, represented in FIG. 5. FIG. 7 is a characteristics diagram representing a relationship between the heat transfer characteristics and the ratio of the gap of the annular passage to the height of the longitudinal vortex generating devices, represented in FIG. 5. FIG. 8 is a characteristics diagram representing a relationship between the heat transfer characteristics and the ratio of the interval of the radiator fins to the gap of the annular passage, represented in FIG. 5. For a better understanding of the heat transfer characteristics, vertical axes in FIGS. 6 to 8 denote changes in general heat transfer characteristics relative to a reference value of 1.0 as heat transfer characteristics of a planar plate having a flat and smooth surface, and horizontal axes denote an ratio R/P of the gap R of the annular passage to the pitch P of the longitudinal vortex generating devices, an ratio R/H of the gap R of the annular passage to the height H of the longitudinal vortex generating devices, and an ratio F/R of the interval F of the radiator fins to the gap R of the annular passage.

It can be seen from these characteristics diagrams that the heat transfer characteristics in the respective ranges of the horizontal axes improve over the reference. In the heat-transfer device 20, however, the ranges of the ratio R/P, the ratio R/H, and the ratio F/R need to be determined in consideration of a balance or trade-off with pressure loss. In a region of small value of ratio F/R, in particular, although the heat transfer characteristics tend to rise, since pressure loss also tends to greatly increase, an appropriate range needs to be set. In addition, the heat transfer characteristics change according to the particular combination of various parameters such as the angle θ of the longitudinal vortex generating devices 22 and the thickness, height, and shape of the radiator fins 24, except for the height H and pitch P of the longitudinal vortex generating devices 22 and the interval F of the radiator fins 24. Therefore, those parameters also require consideration. For these reasons, range settings of the ratio R/P, the ratio R/H, and the ratio F/R are based on parameterized heat-transfer experimental results and numerical analyses.

Next, operational characteristics of the heat-transfer device and the gas turbine combustor having the heat-transfer device according to the first embodiment of the present invention are described below with reference to FIGS. 1, 2, and 4.

When the gas turbine plant shown in FIG. 1 is placed in operation, the combustor liner 8 of the combustor 6 is heated by the heat transfer of the combustion gas 4, while at the same time the combustor liner 8 is cooled by the heat exchange with the combustion air 2 flowing along the outer circumferential surface of the combustor liner 8, in the annular passage 11.

At this time, as shown in FIG. 4, each longitudinal vortex generating device 22 generates a longitudinal vortex E with a central axis in the flow direction of the combustion air 2. The longitudinal vortex E flows downstream while strongly stirring combustion air (cooling air) 2 between the outer circumferential side of the annual passage 11 (i.e., the side closer to the flow sleeve 10) and the inner circumferential side of the annular passage 11 (i.e., the side closer to the combustor liner 8). By the longitudinal vortex E, the low-temperature combustion air 2 is constantly supplied to an outer wall side of the combustor liner 8, downstream in the annular passage 11, and the combustor air 2 that has thereby been heated by the outer wall surface of the liner 8 is carried to the outer circumferential side of the annular passage 11. This allows highly efficient, convective cooling of the combustor liner 8.

In addition, in the regions B where the flow directions of the longitudinal vortices E on their swirling planes are heading from the side closer to the flow sleeve (i.e., the outer circumferential side of the annual passage 11), toward the side closer to the combustor liner 8 (i.e., the inner circumferential side of the annual passage 11), the impact effect of the longitudinal vortices E against the combustor liner 8 can be obtained, which imparts the better heat transfer characteristics (cooling characteristics) to the sections of the combustor liner 8 that are positioned in the regions B.

On the other hand, in the regions A where the flow directions of the longitudinal vortices E on the swirling planes are heading from the side closer to the combustor liner 8, toward the side closer to the flow sleeve 10, the impact effect of the longitudinal vortices E against the combustor liner 8 cannot be obtained. However, by heat exchange between the radiator fins 24 disposed in a standing condition at the sections of the combustor liner 8 that are positioned in the regions A, and the combustion air 2 that has been stirred by the longitudinal vortices E, the heat on the outer circumferential surface of the combustor liner 8 in the regions A is released. As a result, the sections of the combustor liner 8, positioned in the regions A where the impact effect of the longitudinal vortices E cannot be obtained, also obtain better heat transfer characteristics (cooling characteristics). The sections of the combustor liner 8 that are positioned in the regions A and B where the longitudinal vortex E flows in different directions on the swirling plane, both obtain better cooling characteristics, and thus the combustor liner 8 improves in uniformity of its circumferential cooling characteristics.

If the combustor liner 8 shown in FIG. 2 is fitted with only the radiator fins 24 and does not have the longitudinal vortex generating devices 22 mounted on the liner 8, progressive development of boundary layers on outer surfaces (both sides) of each radiator fin 24 is likely and thus the heat transfer characteristics at the downstream side of the combustion air 2 are prone to decrease. In the present embodiment, however, since the longitudinal vortex generating devices 22 and the radiator fins 24 are combined, the longitudinal vortices E disturb the boundary layers generated on the outer surfaces of the radiator fin 24. This disturbance maintains constant heat transfer characteristics in a lengthwise direction of the radiator fin 24 (i.e., in the flow direction of the combustion air 2), which means that the combustor liner 8 improves in uniformity of its cooling characteristics in the flow direction of the combustion air 2.

Additionally, as the longitudinal vortices E within areas separated by the radiator fins 24 arranged circumferentially on the combustor liner 8 flow downstream, expansion of the vortices E is suppressed by the radiator fins 24 and peripheral speed thereof is kept constant without a decrease. Accordingly the stirring effect of the combustion air 2 by the longitudinal vortices E lasts longer in the flow direction of the combustion air 2. In other words, the combustor liner 8 improves in the uniformity of its cooling characteristics in the flow direction of the combustion air 2.

Furthermore, in the present embodiment, the longitudinal vortices E generated by adjacent longitudinal vortex generating devices 22 swirl in directions opposite to each other, and thus, adjacent longitudinal vortices E do not cancel out each other's swirling. Accordingly the stirring effect of the combustion air 2 by the longitudinal vortices E lasts longer in the flow direction of the combustion air 2. In other words, the combustor liner 8 improves in the uniformity of its cooling characteristics in the flow direction of the combustion air 2.

Moreover, in terms of the geometry and layout of the longitudinal vortex generating devices 22 and the arrangement of the radiator fins 24, when the ratio R/P, the ratio R/H, and the ratio F/R are set to fall within the above predetermined ranges, this yields the analytical results that the vortices generated by the longitudinal vortex generating devices 22 become stable longitudinal vortices whose vortex shapes are close to a perfect circle. The longitudinal vortices whose vortex shapes are close to a perfect circle fluctuate less in peripheral speed than longitudinal vortices of other shapes such as an ellipse, and have their energy dissipation suppressed. The longitudinal vortices E are therefore maintained in the flow direction of the combustion air 2, so that the stirring effect of the combustion air 2 by the longitudinal vortices E lasts even longer in the flow direction of the combustion air 2 and hence the combustor liner 8 further improves in the uniformity of its cooling characteristics in the flow direction of the combustion air 2.

As described above, in the heat-transfer device and the gas turbine combustor having the heat-transfer device according to the first embodiment of the present invention, each of the radiator fins 24 is disposed at the section of the combustor liner 8 (the heat transfer object) that is positioned in the region A where the impact effect of the longitudinal vortices E generated by the longitudinal vortex generating devices 22 cannot be obtained. Thus the cooling characteristics of the combustor liner 8 in the region A where the impact effect of the longitudinal vortices E cannot be obtained are improved and become as good as the cooling characteristics of the combustor liner 8 in the region B where the impact effect of the longitudinal vortices E can be obtained. Thus, the combustor liner 8 (the heat transfer object) can improve in the uniformity of its cooling characteristics. This reduces thermal stresses due to sharp changes in temperature, thus extending a life of the combustor liner 8.

Besides, in the present embodiment, the uniform circumferential cooling characteristics of the combustor liner 8 can be obtained since a plurality of longitudinal vortex generating devices 22 and radiator fins 24 are arranged circumferentially on the combustor liner 8 (i.e., in the direction perpendicular to the flow direction of the combustion air 2). Furthermore, in the areas separated by the parallel array of radiator fins 24, the stirring effect of the combustor air 2 by the longitudinal vortices E lasts long in the flow direction of the combustion air 2, thus improving the cooling characteristics of the combustor liner 8 in the flow direction of the combustion air 2.

Second Embodiment

Next, a heat-transfer device and a gas turbine combustor having the heat-transfer device according to a second embodiment of the present invention are described below with reference to FIG. 9.

Figure 9:
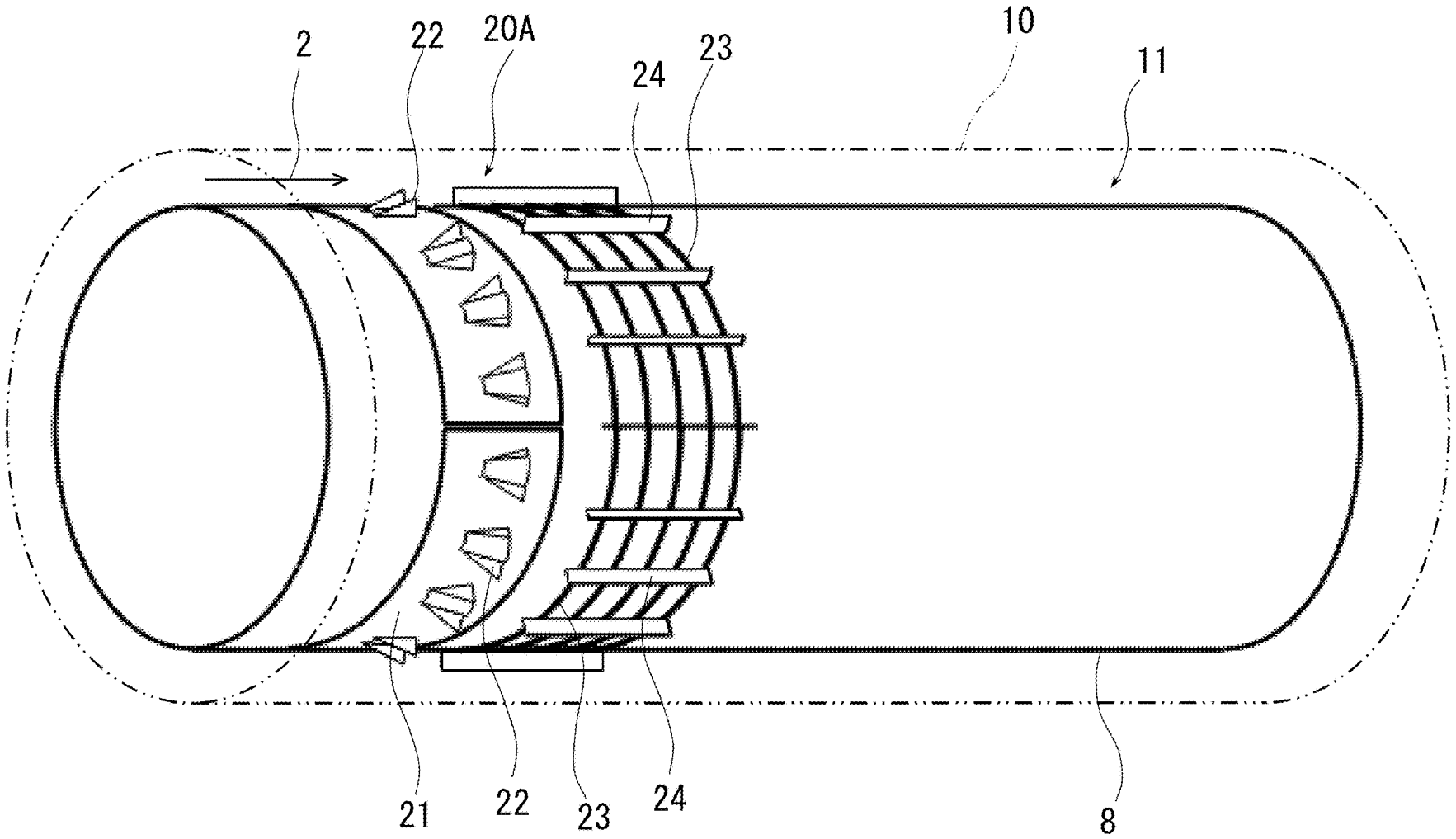
FIG. 9 is a schematic perspective view showing a heat-transfer device according to a second embodiment of the present invention, and a combustor liner that forms a part of a gas turbine combustor having the heat-transfer device.

FIG. 9 is a schematic perspective view showing the heat-transfer device according to the second embodiment of the present invention, and a combustor liner that forms a part of the gas turbine combustor having the heat-transfer device. Referring to FIG. 9, the same elements as used in FIGS. 1 to 8 are each assigned the same reference number and detailed description of these elements is therefore omitted herein.

Besides the longitudinal vortex generating devices 22 and radiator fins 24 that constitute parts of the heat-transfer device 20 according to the first embodiment, the heat-transfer device and the gas turbine combustor having the heat-transfer device according to the second embodiment additionally include ribs 23 serving as turbulent-flow enhancers on outer surface portions of the combustor liner 8 that require cooling, as shown in FIG. 9.

More specifically, the heat-transfer device 20A further includes ribs 23 disposed at locations of the radiator fins 24 on the combustor liner 8. The ribs 23 are linear convex portions provided circumferentially on the combustor liner 8, these convex portions being smaller in height than the radiator fins 24. The ribs 23, for example, have a rectangular cross-sectional shape. In addition, the ribs 23 are arranged in rows (in FIG. 9, five rows) at predetermined intervals in a flow direction of combustion air 2, and provided in a zone extending to both lengthwise ends of each radiator fin 24. Integration by centrifugal casting, welding, brazing, or the like, can be used as a method of disposing the ribs 23 on an outer circumferential surface of the combustor liner 8.

The ribs 23 extend at substantially right angles to a main flow direction of the combustion air (cooling air) 2, for which reason, the ribs 23 generate complex vortices including a small longitudinal vortex component near a wall surface of the annular passage 11. Unlike the longitudinal vortices E generated by the longitudinal vortex generating devices 22, the above complex vortices do not have a strong stirring effect upon the fluid flow in the entire area of the annular passage 11. These vortices are however effective for destroying boundary layers of the combustion air 2 which has been stirred by the longitudinal vortex generating devices 22, the boundary layers being near the wall surface of the combustor liner 8. The ribs 23 arranged in parallel in the flow direction of the combustion air 2 are combined with the longitudinal vortex generating devices 22 and the radiator fins 24, to further enhance the cooling characteristics of the combustor liner 8.

Height of the ribs 23 here is set to be smaller than those of the longitudinal vortex generating devices 22 and the radiator fins 24, and in terms of destroying boundary layers, preferable rib height is nearly 1 to 3 mm, depending on thickness of the boundary layers. In addition, the cross-sectional shapes of the ribs 23 do not always need to be rectangular and may be any other shape having a function that destroys the boundary layers.

For these reasons, the heat-transfer device and the gas turbine combustor having the heat-transfer device according to the second embodiment of the present invention yield substantially the same advantageous effects as those of the first embodiment.

In the present embodiment, the effect of cooling the combustor liner 8 can also be further enhanced because the ribs 23 on the combustor liner 8 destroy the boundary layers of the combustion air (cooling air) 2 that occur near the outer surface of the combustor liner 8.

Third Embodiment

Next, a heat-transfer device and a gas turbine combustor having the heat-transfer device according to a third embodiment of the present invention are described below with reference to FIGS. 10 and 11.

Figure 10:
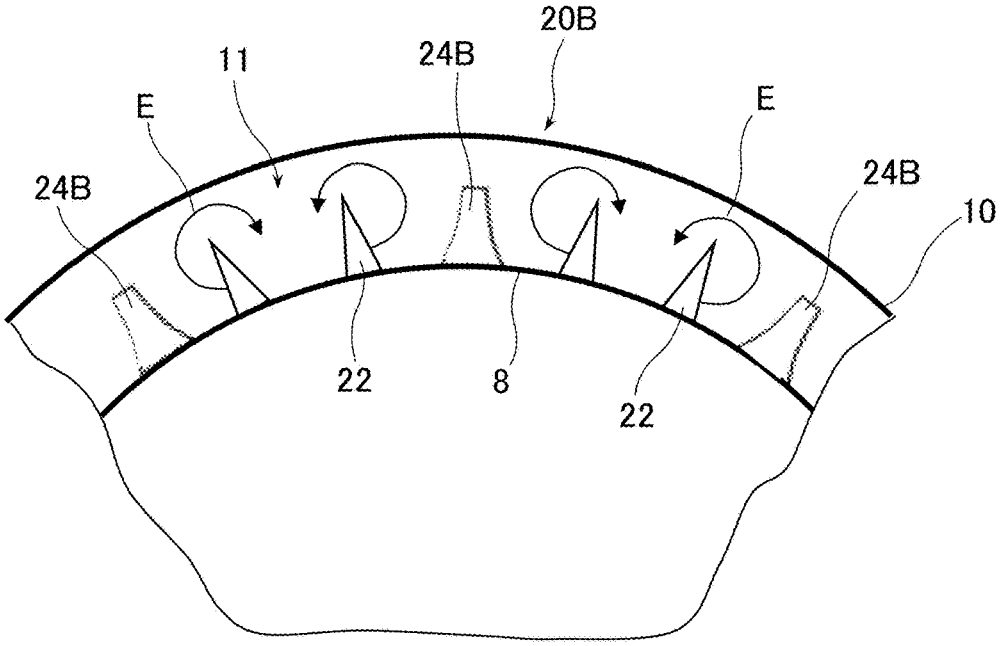
FIG. 10 is a schematic cross-sectional view that shows part of a gas turbine combustor having a heat-transfer device according to a third embodiment of the present invention.

FIG. 10 is a schematic cross-sectional view that shows part of the gas turbine combustor having the heat-transfer device according to the third embodiment of the present invention. FIG. 11 shows a comparative example relating to fluid flow in an annular passage of the gas turbine combustor having the heat-transfer device according to the third embodiment of the present invention, the comparative example being shown to illustrate the fluid flow in the annular passage of the gas turbine combustor having the heat-transfer device according to the first embodiment of the present invention. Referring to FIGS. 10 and 11, the same elements as used in FIGS. 1 to 9 are each assigned the same reference number and detailed description of these elements is therefore omitted herein.

In the heat-transfer device and the gas turbine combustor having the heat-transfer device according to the third embodiment of the present invention, shown in FIG. 10, a cross section of each radiator fin 24B has a concave outer profile obtained by curvilinearly forming a geometrical shape of a portion of an ellipsis, whereas each of the radiator fins 24 which form parts of the first embodiment has a substantially rectangular cross-sectional shape. More specifically, each of the radiator fins 24B of the heat-transfer device 20B is formed so that its cross-section is gradually thinner as it go upward from a base toward a tip. Each of the radiator fins 24B is also formed so that the outer profile of its cross-section has the concave shape obtained by curvilinearly forming the geometrical shape of a portion of an ellipsis.

Compared with that in the first embodiment, the flow of combustion air 2 in the annular passage 11 in the third embodiment has the following difference.

Figure 11:
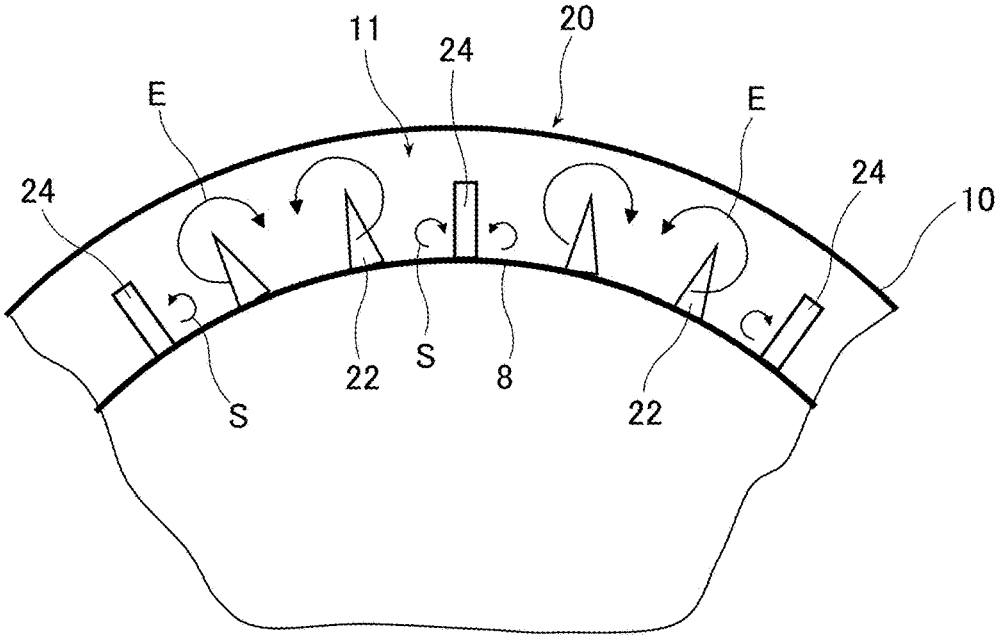
FIG. 11 is an explanatory diagram that shows fluid flow in an annular passage of the gas turbine combustor having the heat-transfer device according to the first embodiment of the present invention.

In the first embodiment, as shown in FIG. 11, the radiator fins 24 of the rectangular cross-sectional shape are disposed in a standing condition on the combustor liner 8, so the radiator fins 24 are not connected smoothly at outer profile sections of their bases to the outer surface of the combustor liner 8. For this reason, the longitudinal vortices E generated by the longitudinal vortex generating devices 22 tend to cause very small vortices S as secondary flows at the bases of the radiator fins 24, and hence may cause an increase in pressure loss of the combustion air (cooling air) 2.

In the present embodiment, on the other hand, since as shown in FIG. 10, the cross section of each radiator fins 24B has the concave outer profile obtained by curvilinearly forming the geometrical shape of a portion of a ellipsis, the radiator fins 24B are connected more smoothly than the radiator fins 24 in the first embodiment, at the outer profile sections of their bases to the outer surface of the combustor liner 8. This suppresses the occurrence of a secondary flows (very small vortices) due to longitudinal vortices E at the bases of the radiator fins 24B.

For these reasons, the heat-transfer device and the gas turbine combustor having the heat-transfer device according to the third embodiment of the present invention yield substantially the same advantageous effects as those of the first embodiment.

In the present embodiment, since the cross sections of the radiator fins 24B have the concave outer profiles obtained by curvilinearly forming the geometrical shape of a portion of an ellipsis, the occurrence of secondary flows (very small vortices) due to the longitudinal vortices E at the bases of the radiator fins 24B is also suppressed and thus pressure loss of the combustion air 2 can be reduced without deterioration of heat transfer characteristics (cooling characteristics).

Fourth Embodiment

Next, a heat-transfer device and a gas turbine combustor having the heat-transfer device according to a fourth embodiment of the present invention are described below with reference to FIG. 12.

Figure 12:
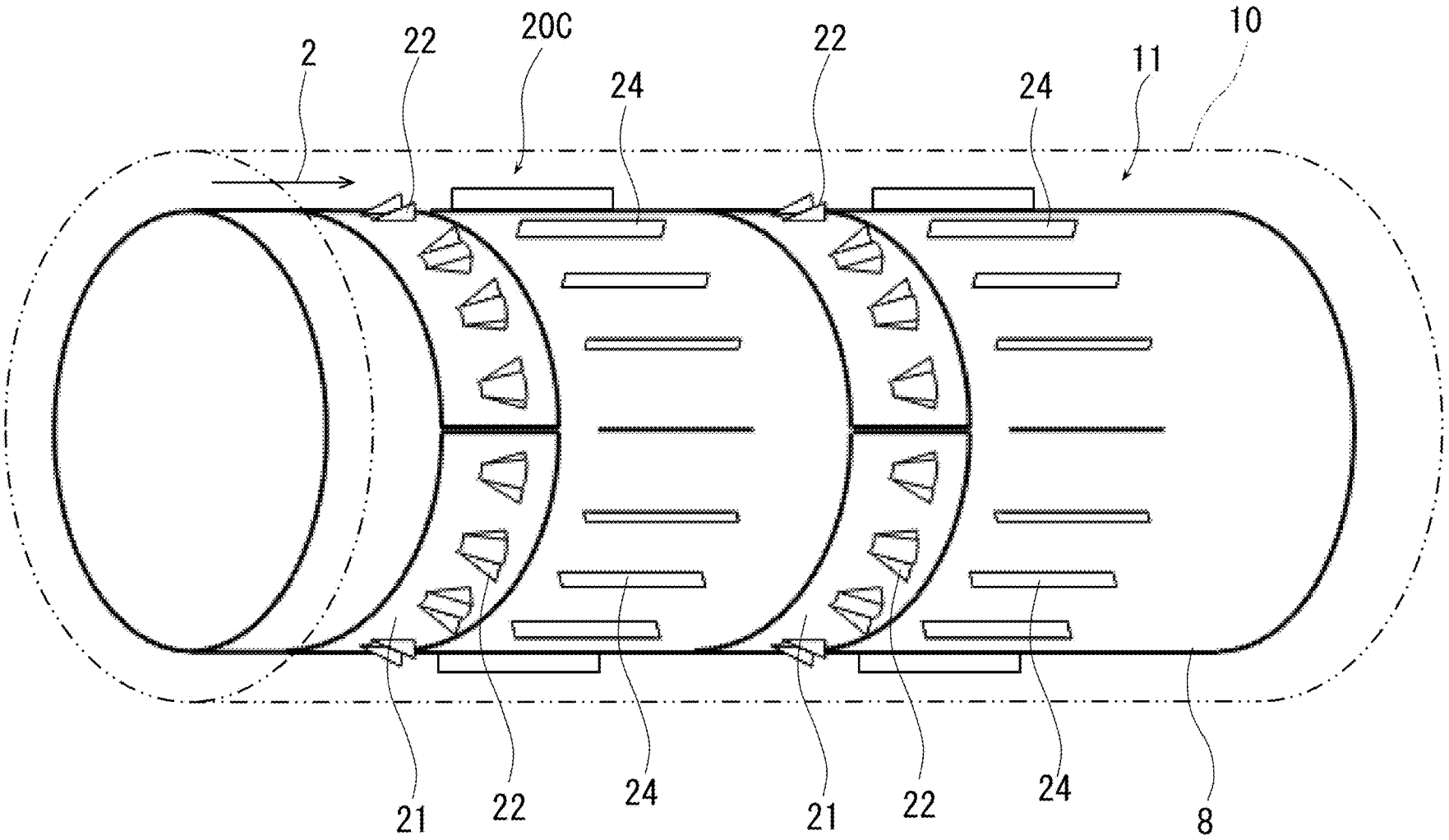
FIG. 12 is a schematic perspective view showing a heat-transfer device according to a fourth embodiment of the present invention, and a combustor liner that constitutes a part of a gas turbine combustor having the heat-transfer device.

FIG. 12 is a schematic perspective view showing the heat-transfer device according to the fourth embodiment of the present invention, and a combustor liner that constitutes a part of the gas turbine combustor having the heat-transfer device. Referring to FIG. 12, the same elements as used in FIGS. 1 to 11 are each assigned the same reference number and detailed description of these elements is therefore omitted herein.

The heat-transfer device and the gas turbine combustor having the heat-transfer device according to the fourth embodiment of the present invention, shown in FIG. 12, differ from those of the first embodiment in that the heat-transfer device 20C has a plurality of substantially the same heat-transfer devices 20 of the first embodiment in a flow direction of combustion air 2. In other words, the heat-transfer device 20C has a plurality of sets of a strap member 21, longitudinal vortex generating devices 22, and radiator fins 24. The plurality of sets are disposed in rows (in FIG. 12, two rows) in the flow direction of the combustion air 2.

Compared with longitudinal vortices E in the one-row placement of longitudinal vortex generating devices 22, longitudinal vortices E in two-row placement give stronger stirring effect in the flow direction of the combustion air 2. More specifically, since the heat-transfer device 20C is constructed so that before the longitudinal vortices E that have been generated by the first row of longitudinal vortex generating devices 22 disappear, the second row of longitudinal vortex generating devices 22 generate longitudinal vortices E, generated longitudinal vortices E can be maintained over an entire length of the combustor liner 8. In addition, a size of the longitudinal vortices E to be generated can be changed by changing dimensions, height, and spread angle of the first and second rows of longitudinal vortex generating devices 22.

For these reasons, the heat-transfer device and the gas turbine combustor having the heat-transfer device according to the fourth embodiment of the present invention yield substantially the same advantageous effects as those of the first embodiment.

In the present embodiment, since a plurality of sets of longitudinal vortex generating devices 22 and radiator fins 24 are disposed in the flow direction of the combustion air 2, the stirring effect of longitudinal vortices E in the flow direction of the combustion air 2 is strengthened and thus the combustion liner 8 can improve in its cooling characteristics in the flow direction of the combustion air 2.

Fifth Embodiment

Next, a heat-transfer device and a gas turbine combustor having the heat-transfer device according to a fifth embodiment of the present invention are described below with reference to FIG. 13.

Figure 13:
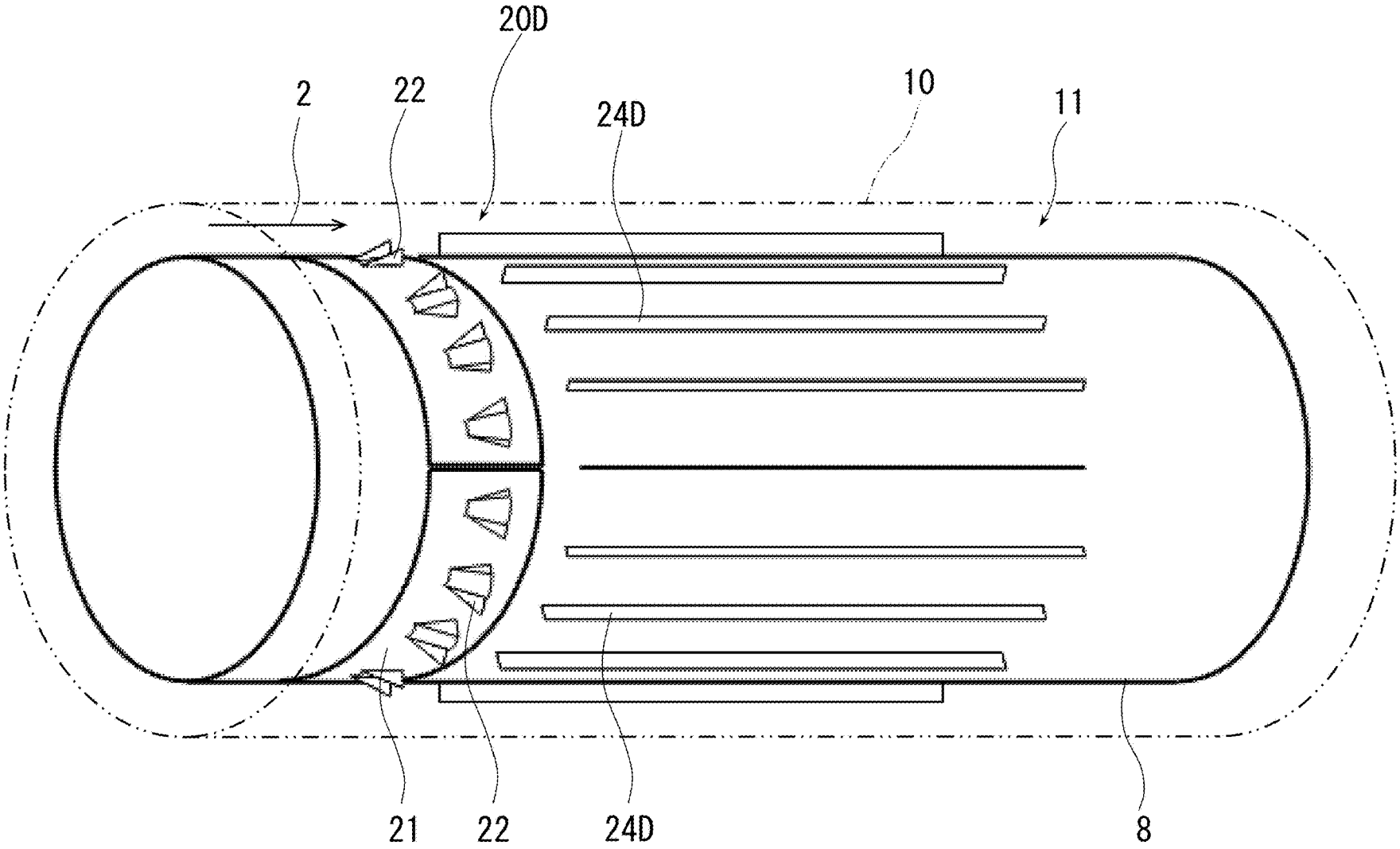
FIG. 13 is a schematic perspective view showing a heat-transfer device according to a fifth embodiment of the present invention, and a combustor liner that constitutes a part of a gas turbine combustor having the heat-transfer device.

FIG. 13 is a schematic perspective view showing the heat-transfer device according to the fourth embodiment of the present invention, and a combustor liner that constitutes a part of the gas turbine combustor having the heat-transfer device. Referring to FIG. 13, the same elements as used in FIGS. 1 to 12 are each assigned the same reference number and detailed description of these elements is therefore omitted herein.

The heat-transfer device and the gas turbine combustor having the heat-transfer device according to the fifth embodiment of the present invention, shown in FIG. 13, differ from those of the fourth embodiment in the following context. In the fourth embodiment, a set of longitudinal vortex generating devices 22 and radiator fins 24 is disposed in two rows in the flow direction of combustion air 2 to improve the cooling characteristics of the combustor liner 8 over the entire length thereof. In the fifth embodiment, however, a set of longitudinal vortex generating devices 22 and radiator fins 24D is disposed on the outer surface of the combustor liner 8 and the radiator fins 24D are formed as long as possible in a lengthwise direction of the combustor liner 8 to improve cooling characteristics of the combustor liner 8 over the entire length thereof. In other words, the radiator fins 24D of the heat-transfer device 20D extend to overall length of a region requiring the cooling of the combustor liner 8 in the lengthwise direction thereof, that is, in the flow direction of the combustion air 2.

The present embodiment is particularly effective in cases where hot sections of the combustor liner 8 are to be cooled by using the radiator fins 24D in conjunction with the longitudinal vortices E generated by the longitudinal vortex generating devices 22, and relative cold sections are to be cooled with the radiator fins 24D only. In this case, the combustor liner 8 can improve in the uniformity of its cooling characteristics in the lengthwise direction.

In the heat-transfer device and in the gas turbine combustor having the heat-transfer device according to the fifth embodiment of the present invention, since the number of rows of longitudinal vortex generating devices 22 in the heat-transfer device 20D is one, its heat transfer structure can be simplified in comparison with that of the fourth embodiment shown in FIG. 12.

Sixth Embodiment

Next, a heat-transfer device and a gas turbine combustor having the heat-transfer device according to a sixth embodiment of the present invention are described below with reference to FIGS. 14 and 15.

Figure 14:
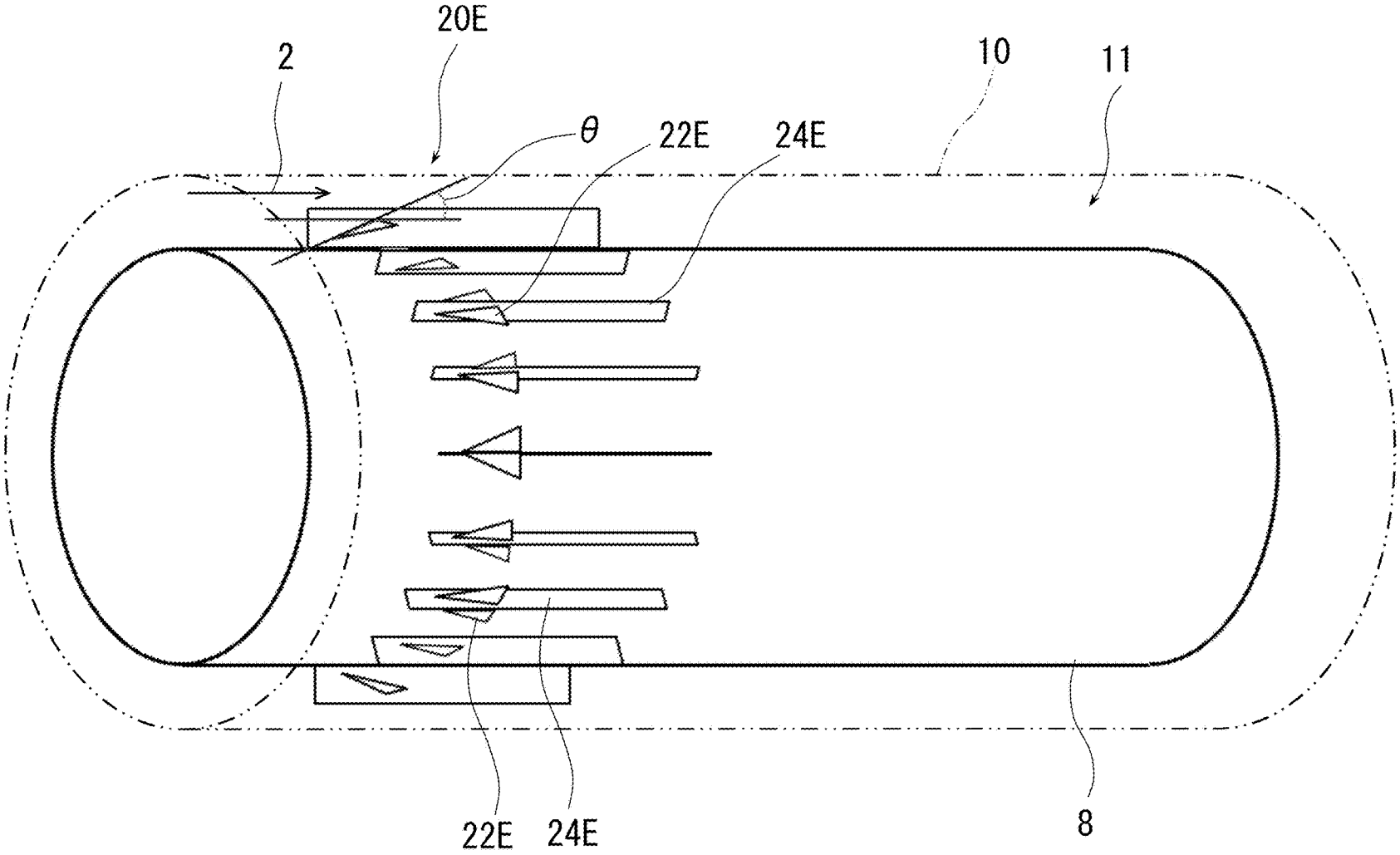
FIG. 14 is a schematic perspective view showing a heat-transfer device according to a sixth embodiment of the present invention, and a combustor liner that forms a part of a gas turbine combustor having the heat-transfer device.
Figure 15:
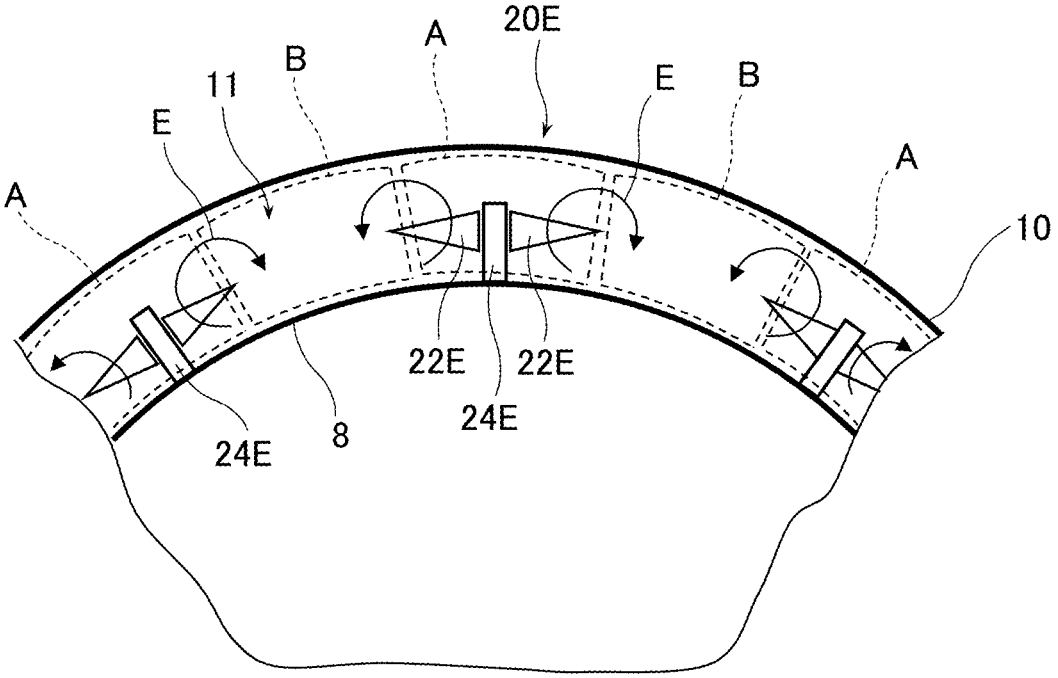
FIG. 15 is a schematic cross-sectional view that shows part of the gas turbine combustor having the heat-transfer device according to the sixth embodiment of the present invention, shown in FIG. 14.

FIGS. 14 and 15 show the heat-transfer device and the gas turbine combustor having the heat-transfer device according to the sixth embodiment of the present invention. FIG. 14 is a schematic perspective view showing the heat-transfer device according to the sixth embodiment of the present invention, and a combustor liner that forms a part of the gas turbine combustor having the heat-transfer device. FIG. 15 is a schematic cross-sectional view showing part of the gas turbine combustor having the heat-transfer device according to the sixth embodiment of the present invention. Referring to FIGS. 14 and 15, the same elements as used in FIGS. 1 to 13 are each assigned the same reference number and detailed description of these elements is therefore omitted herein.

The heat-transfer device according to the sixth embodiment of the present invention includes longitudinal vortex generating devices 22E on both sides of each of plate-shaped radiator fins 24E extending in a flow direction of combustion air 2.

More specifically, the plate-shaped radiator fins 24E of the heat-transfer device 20E are disposed in a standing condition on an outer circumferential surface of the combustor liner 8, at upstream sections in the flow direction of the combustion air 2. Longitudinal vortex generating devices 22E are disposed on both sides of each plate-shaped radiator fin 24E, at upstream sections in the flow direction of the combustion air 2. The longitudinal vortex generating devices 22E are convex portions protruding from the sides of the radiator fins 24E toward an annular passage 11. Height of each longitudinal vortex generating device 22E is set so that an edge of the device 22E gradually rises as it goes downstream of the combustion air 2. In addition, the longitudinal vortex generating device 22E is inclined at a predetermined angle θ (say, from 10 to 20 degrees) with respect to the flow direction of the combustion air 2 so that an upstream end of the longitudinal vortex generating device 22, in the flow direction of the combustion air 2, is positioned closer to the combustor liner 8 than a downstream end of the longitudinal vortex generating device 22E. A plurality sets of one radiator fin 24E and longitudinal vortex generating devices 22 provided on both sides of the fin 24E are disposed at predetermined intervals circumferentially on the combustor liner 8.

In the heat-transfer device 20E having the above configuration, longitudinal vortices E with central axes in the flow direction of the combustion air 2 are generated by the longitudinal vortex generating devices 22 as shown in FIG. 15. The longitudinal vortices E flow downstream while strongly stirring the combustion air 2 that flows within areas of the annular passage 11 separated by the radiator fins 24E. By the longitudinal vortices E, the low-temperature combustion air 2 is constantly supplied to an outer wall side of the combustor liner 8, downstream in the areas of the annular passage 11 separated by the radiator fins 24E, and the combustor air 2 that has thereby been heated by the outer wall surface of the liner 8 is carried to an outer circumferential side in the areas of the annular passage 11 separated by the radiator fins 24E. This allows highly efficient, convective cooling of the combustor liner 8.

In addition, since as shown in FIG. 14, each longitudinal vortex generating device 22E is inclined so that the upstream end thereof, in the flow direction of the combustion air 2, is positioned closer to the combustor liner 8 than the downstream end of the longitudinal vortex generating device 22E, each radiator fins 24E becomes positioned in the region A where the flow direction of the longitudinal vortex E, on a swirling plane thereof, that is generated by the longitudinal vortex generating device 22E is heading from the side closer to the combustor liner 8, toward the side closer to a flow sleeve 10. Accordingly the section of the combustor liner 8 that is positioned in the region A where impact effect of the longitudinal vortex E cannot be obtained can gain better heat transfer characteristics (cooling characteristics) by heat exchange between the radiator fin 24E and the combustion air 2 that has been stirred by the longitudinal vortex E. The section of the combustor liner 8 that is positioned in the region B where no radiator fins 24E are placed can obtain better heat transfer characteristics (cooling characteristics) by the impact effect of the longitudinal vortex E. The sections of the combustor liner 8 that are positioned in the regions A and B where the longitudinal vortex E flows in different directions on the swirling plane, both obtain appropriate cooling characteristics, and thus the combustor liner 8 improves in uniformity of its circumferential cooling characteristics.

As described above, in the heat-transfer device and the gas turbine combustor having the heat-transfer device according to the sixth embodiment of the present invention, the radiator fins 24E are disposed in a standing condition at the sections of the combustor liner 8 (the heat transfer object) that are positioned in the regions A where the impact effect of the longitudinal vortices E generated by the longitudinal vortex generating devices 22E cannot be obtained. Thus the cooling characteristics of the combustor liner 8 in the regions A where the impact effect of the longitudinal vortices E cannot be obtained are improved and become as good as the cooling characteristics of the combustor liner 8 in the regions B where the impact effect of the longitudinal vortices E can be obtained. Accordingly, the combustor liner 8 (the heat transfer object) can improve in the uniformity of its cooling characteristics. This reduces thermal stresses due to sharp changes in temperature, thus extending a life of the combustor liner 8.

Furthermore, in the present embodiment, since the longitudinal vortex generating devices 22E are placed on both sides of each radiator fin 24E, not on the combustor liner 8, welding the longitudinal vortex generating devices 22E to the liner 8 is unnecessary and high structural reliability of the combustor liner 8 can be obtained.

Other Embodiments

The above-described embodiments of the present invention uses the combustor liner 8 of the gas turbine combustor as a heat transfer object. However, any other objects can be used instead of the combustor liner 8, as long as the heat transfer medium, such as air, can flow along the surface of the objects.

In addition, while an example of forming the longitudinal vortex generating devices 22 on the strap member 21 and placing the longitudinal vortex generating devices 22 on the combustor liner 8 has been shown and described in each of the first to fifth embodiments of the present invention, if longitudinal vortex generating devices 22 have a function that generates longitudinal vortices E, the longitudinal vortex generating devices do not always need to be formed on the strap member. For example, the combustor liner 8 and separately fabricated longitudinal vortex generating devices can likewise be integrated into a single unit by welding or brazing.

Although the heat-transfer device 20E including the longitudinal vortex generating devices 22E and the radiator fins 24E has been shown and described as an example in the sixth embodiment, turbulent-flow enhancers may be provided in addition to the longitudinal vortex generating devices 22E and the radiator fins 24E, as in the second embodiment.

In addition, although the radiator fins 24E whose cross-sectional shape is rectangular has been shown and described as an example in the sixth embodiment, the cross-sectional shape of the radiator fins 24E may be replaced by substantially the same shape as employed in the third embodiment.

Although an example in which one row of longitudinal vortex generating devices 22E and radiator fins 24E are arranged as one set has been shown and described in the sixth embodiment, a plurality of sets of longitudinal vortex generating devices 22E and radiator fins 24E may be arranged in the flow direction of the combustion air 2, as in the fourth embodiment.

Furthermore, in the sixth embodiment, radiator fins 24E as long as possible in the lengthwise direction of the combustor liner 8 may be formed as in the fifth embodiment.

Also, the foregoing embodiments illustrate examples where the heat-transfer devices each include multiple longitudinal vortex generating devices and radiator fins. However, one of the essential effects achieved by the invention is to improve the cooling characteristics of the combustor liner 8 in the region A where the impact effect of the longitudinal vortex E cannot be obtained. It should be noted that at least one longitudinal vortex generating device and radiator fin is necessary in order to improve the cooling characteristics of the combustor liner 8 in the region A.

The present invention is not limited to the first to sixth embodiments and embraces varieties of variations and modifications. The embodiments have only been described in detail for a better understanding of the invention and are therefore not necessarily limited to the configurations containing all described constituent elements. In addition, part of the configuration of a certain embodiment may be replaced by the configuration of another embodiment and the configuration of a certain embodiment may be added to the configuration of another embodiment. Furthermore, part of the configuration of one of the embodiments may be added to, deleted from, and/or replaced by the other embodiments.

What is claimed is:

1. A heat-transfer device for facilitating heat exchange between a heat transfer object and a heat transfer medium flowing along a surface of the heat transfer object, the heat-transfer device comprising:

at least one longitudinal vortex generating device protruding from a surface side of the heat transfer object toward a flow passage of the heat transfer medium, the at least one longitudinal vortex generating device being configured to generate a longitudinal vortex with a central axis in a flow direction of the heat transfer medium to stir the heat transfer medium flowing in the flow passage; and at least one radiator fin provided on the surface of the heat transfer object only in a region A out of two regions A and B which differ in flow direction on a swirling plane of the longitudinal vortex by the at least one longitudinal vortex generating device, no radiator fins being placed in the region B, the region A being a region where a flow of the longitudinal vortex, on the swirling plane is directed away from a heat transfer object side, the region B being a region where a flow of the longitudinal vortex on the swirling plane is directed toward the heat transfer object side, an entirety of the at least one radiator fin being disposed only in an area downstream from the at least one longitudinal vortex generating device in the flow direction of the heat transfer medium, the at least one radiator fin being configured to exchange heat with the heat transfer medium stirred by the at least one longitudinal vortex generating device.

2. The heat-transfer device according to claim 1, wherein:

the at least one longitudinal vortex generating device is a convex portion; and the at least one radiator fin is a plate-shaped member disposed in a standing condition on the surface of the heat transfer object, the at least one radiator fin extending in the flow direction of the heat transfer medium.

3. The heat-transfer device according to claim 2, wherein:

the at least one longitudinal vortex generating device is inclined in a direction parallel to the surface of the heat transfer object, at an angle of a predetermined range with respect to the flow direction of the heat transfer medium.

4. The heat-transfer device according to claim 2, wherein:

the at least one longitudinal vortex generating device and the at least one radiator fin respectively comprise a plurality of longitudinal vortex generating devices and a plurality of radiator fins, the plurality of longitudinal vortex generating devices and the plurality of radiator fins are respectively arranged in a direction perpendicular to the flow direction of the heat transfer medium.

5. The heat-transfer device according to claim 4, wherein:

longitudinal vortex generating devices adjacent to each other among the plurality of longitudinal vortex generating devices are formed to generate longitudinal vortices whose swirling directions are opposite to each other.

6. The heat-transfer device according to claim 5, wherein:

geometry and layout of the plurality of longitudinal vortex generating devices and arrangement of the plurality of radiator fins are such that the following is satisfied:

$$0.5 \leq R/P \leq 3.8;$$

$$1.1 \leq R/H \leq 5.0; \text{ and}$$

$$0.5 \leq F/R \leq 3.6,$$

wherein R, P, H, and F respectively denote a gap of the flow passage in a direction perpendicular to the heat transfer object, a pitch of the longitudinal vortex generating devices, height of the longitudinal vortex generating devices, and an interval between the radiator fins.

7. The heat-transfer device according to claim 2, wherein:

the at least one radiator fin extends along an overall length of a section of the heat transfer object that needs cooling in the flow direction of the heat transfer medium.

8. The heat-transfer device according to claim 1, further comprising:

at least one turbulent-flow enhancer provided on the surface of the heat transfer object, the at least one turbulent-flow enhancer being configured to destroy a boundary layer of the heat transfer medium stirred by the at least one longitudinal vortex generating device, the boundary layer generated on the surface of the heat transfer object.

9. The heat-transfer device according to claim 1, wherein:

the at least one longitudinal vortex generating device and the at least one radiator fin respectively comprise a plurality of longitudinal vortex generating devices and a plurality of radiator fins, the plurality of longitudinal vortex generating devices are arranged in the flow direction of the heat transfer medium, and the plurality of radiator fins are arranged in the flow direction of the heat transfer medium.

10. A gas turbine combustor comprising:

a combustor liner having an outer circumferential surface; and the heat-transfer device according to claim 1, placed on the outer circumferential surface of the combustor liner as the heat transfer object.

11. A heat-transfer device for facilitating heat exchange between a heat transfer object and a heat transfer medium flowing along a surface of the heat transfer object, the heat-transfer device comprising:

at least one longitudinal vortex generating device protruding toward a flow passage of the heat transfer medium, the at least one longitudinal vortex generating device being configured to generate a longitudinal vortex with a central axis in a flow direction of the heat transfer medium to stir the heat transfer medium flowing in the flow passage; and at least one radiator fin provided on the surface of the heat transfer object only in a region A out of two regions A and B which differ in flow direction on a swirling plane of the longitudinal vortex by the at least one longitudinal vortex generating device, the region A being a region where a flow of the longitudinal vortex on the swirling plane is directed away from a heat transfer object side, the region B being a region where a flow of the longitudinal vortex on the swirling plane is directed toward the heat transfer object side, the at least one radiator fin being configured to exchange heat with the heat transfer medium stirred by the at least one longitudinal vortex generating device, wherein:

the at least one longitudinal vortex generating device is a convex portion protruding from a surface side of the heat transfer object toward the flow passage;

the at least one radiator fin is a plate-shaped member disposed in a standing condition on the surface of the heat transfer object, downstream of the at least one longitudinal vortex generating device in the flow direction of the heat transfer medium, the at least one radiator fin extending in the flow direction of the heat transfer medium; and the at least one radiator fin is formed so that a cross-section of the radiator fin is gradually thinner from a base toward a tip and so that an outer profile of the cross-section has a concave shape obtained by curvilinearly forming a geometrical shape of a portion of an ellipsis.

* * * * *